US007281505B2

(12) United States Patent
Murase et al.

(10) Patent No.: US 7,281,505 B2
(45) Date of Patent: Oct. 16, 2007

(54) VARIABLE LIFT VALVE OPERATING SYSTEM FOR INTERNAL COMBUSTION ENGINE

(75) Inventors: Hiroyuki Murase, Wako (JP); Takahumi Mizorogi, Wako (JP); Hidetaka Ozawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/480,564

(22) Filed: Jul. 5, 2006

(65) Prior Publication Data

US 2007/0017462 A1 Jan. 25, 2007

(30) Foreign Application Priority Data

| | | |
|---|---|---|
| Jul. 8, 2005 | (JP) | 2005-200729 |
| Jul. 8, 2005 | (JP) | 2005-200731 |
| Jul. 8, 2005 | (JP) | 2005-200732 |
| May 26, 2006 | (JP) | 2006-146170 |

(51) Int. Cl.
*F01L 1/34* (2006.01)

(52) U.S. Cl. ..... 123/90.16; 123/90.15; 123/90.11

(58) Field of Classification Search ..... 123/90.16, 123/90.15, 90.31
See application file for complete search history.

(56) References Cited

U.S. PATENT DOCUMENTS 5,680,837 A * 10/1997 Pierik ..... 123/90.17
6,019,076 A 2/2000 Pierik et al. ..... 123/90.16

FOREIGN PATENT DOCUMENTS

| | | |
|---|---|---|
| GB | 139409 | 3/1920 |
| JP | 2000-234507 | 8/2000 |
| JP | 2005-42642 | 2/2005 |
| WO | WO 03/069134 | 8/2003 |

OTHER PUBLICATIONS

European Search Report mailed Oct. 30, 2006, 2 pages.

* cited by examiner

*Primary Examiner*—Zelalem Eshete
(74) *Attorney, Agent, or Firm*—Kratz, Quintos & Hanson, LLP

(57) ABSTRACT

In a variable lift valve operating system for an internal combustion engine, an actuator for rotatably driving a control shaft of a variable lift mechanism is mounted on an engine body. The actuator includes an electric motor, a deceleration mechanism, a transmission mechanism interposed between the control shaft and the deceleration mechanism, and a default mechanism. A deceleration mechanism accommodation part for accommodating the deceleration mechanism and a default mechanism accommodation part for accommodating the default mechanism are formed in a casing of the actuator so as to sandwich therebetween a thermally vulnerable part which is directly connected to the control shaft. Therefore, it is possible to enhance the degree of freedom of amounting position of the actuator while heat damage is prevented from generating in the thermally vulnerable part of the actuator.

8 Claims, 17 Drawing Sheets

VARIABLE LIFT VALVE OPERATING SYSTEM FOR INTERNAL COMBUSTION ENGINE

RELATED APPLICATION DATA

The Japanese priority application Nos. 2005-200729, 2005-200731, 2005-200732 and 2006-146170 upon which the present application is based are hereby incorporated in their entirety herein by reference.

BACKGROUND OF THE INVENTION

1. Field of the Invention

The present invention relates to a variable lift valve operating system for an internal combustion engine comprising: an engine valve; a variable lift mechanism capable of changing a lift amount of the engine valve; and an actuator which is mounted on an engine body to rotatably drive a control shaft of the variable lift mechanism and which includes: an electric motor; a deceleration mechanism which decelerates output of the electric motor; a transmission mechanism interposed between the control shaft and the deceleration mechanism; and a default mechanism capable of rotatably biasing the control shaft to a position where a lift amount of the engine valve becomes a predetermined lift amount when the electric motor is not energized.

2. Description of the Related Art

Japanese Patent Application Laid-open No. 2005-42642 discloses an engine valve system, in which an actuator mounted on an engine body so as to drive a control shaft includes an electric motor, a screw shaft rotatably driven by the electric motor, and a nut that is connected to one end portion of a lever whose other end portion is fixed to the control shaft and that is threadedly fitted onto the screw shaft.

It is desirable that some of the components of the actuator of such a variable lift operating system be made of a synthetic resin for reduction in weight and friction, and that sensors whose characteristics change in accordance with the ambient temperature be mounted to the actuator, but the synthetic resin components and the sensors are vulnerable to heat. Meanwhile, since the actuator is mounted on the engine body, the actuator is exposed to rearward-blowing wind of a radiator or radiation heat from an exhaust system of the internal combustion engine depending on the mounting position of the actuator to the engine main body, so that the degree of freedom of the mounting position of the actuator using the thermally vulnerable parts is lowered.

SUMMARY OF THE INVENTION

The present invention has been achieved with the above circumstances in view, and has an object to provide a variable lift valve operating system for an internal combustion engine in which the degree of freedom of a mounting position of an actuator is enhance while heat damage is prevented from generating in a thermally vulnerable part of the actuator.

In order to achieve the above object, according to a first feature of the present invention, there is provided a variable lift valve operating system for an internal combustion engine comprising: an engine valve; a variable lift mechanism capable of changing a lift amount of the engine valve; and an actuator which is mounted on an engine body to rotatably drive a control shaft of the variable lift mechanism and which includes: an electric motor; a deceleration mechanism which decelerates output of the electric motor; a transmission mechanism interposed between the control shaft and the deceleration mechanism; and a default mechanism capable of rotatably biasing the control shaft to a position where a lift amount of the engine valve becomes a predetermined lift amount when the electric motor is not energized, wherein a deceleration mechanism accommodation part for accommodating the deceleration mechanism and a default mechanism accommodation part for accommodating the default mechanism are formed in a casing of the actuator so as to sandwich therebetween a thermally vulnerable part which is directly connected to the control shaft.

With this arrangement of the first feature, the thermally vulnerable part is sandwiched between the deceleration mechanism accommodation part and the default mechanism accommodation part which are formed in the casing. Therefore, the deceleration mechanism accommodation part and the default mechanism accommodation part perform the heat shield function for the thermally vulnerable part, heat damage is prevented from spreading to the thermally vulnerable part to enhance durability of the thermally vulnerable part, and heat damage is prevented from generating in the vulnerable part to enhance the degree of freedom of a mounting position of the actuator.

According to a second feature of the present invention, in addition to the first feature, the thermally vulnerable part is a sensor which detects a rotation amount of the control shaft. With this arrangement, although the sensor changes in characteristics in accordance with the ambient temperature, detection accuracy of the sensor can be enhanced by preventing the sensor from being directly exposed to hot air and radiation heat by sandwiching the sensor between the deceleration mechanism accommodation part and the default mechanism accommodation part.

According to a third feature of the present invention, in addition to the first feature, the thermally vulnerable part is a synthetic resin worm wheel which constitutes a part of the transmission mechanism and is fixed to the control shaft. With this arrangement, it is possible to achieve reduction in weight of the actuator and reduction in friction by using the worm wheel formed from a synthetic resin, and prevent heat damage from spreading to the worm wheel by sandwiching the worm wheel between the deceleration mechanism accommodation part and the default mechanism accommodation part, thereby enhancing reliability and durability, and further preventing increase in friction by thermal deformation or the like to achieve energy saving.

According to a fourth feature of the present invention, in addition to the first feature, the default mechanism further includes a default shaft which is a separate member from the drive shaft and has an axis parallel with the drive shaft, a rotary member which is capable of rotating around the axis of the default shaft and is moved with and connected to the drive shaft, and a default spring which rotatably biases the rotary member; and at least a main part of the default mechanism is provided in the actuator.

With this arrangement of the fourth feature, the rotary member which is a separate member from the drive shaft and rotates around the axis of the default shaft parallel with the drive shaft can be moved with and connected to the drive shaft so that the rotary member rotates in a rotation range of less than one rotation corresponding to the rotation of the electric motor within the range of the lift amount change of the engine valve. Therefore, a conventionally-used default mechanism with high durability and reliability can be adopted.

According to a fifth feature of the present invention, in addition to the fourth feature, the default spring is of a spiral type. With this arrangement, the default mechanism can be made compact in the direction along the axis of the default shaft.

According to a sixth feature of the present invention, in addition to the fifth feature, the default mechanism accommodation part is formed in the casing of the actuator, the default mechanism accommodation part accommodating a main part of the default mechanism, the main part including at least the default spring; and a grease is charged into the default mechanism accommodation part. With this arrangement, sliding friction force which tends to be large due to the spiral-type default spring is reduced, and the power which should be exhibited by the electric motor is reduced to achieve energy saving, leading to reduced fuel consumption.

According to a seventh feature of the present invention, in addition to the first feature, in the casing of the actuator, a plurality of mounting bosses are projectingly provided at a plurality of spots around the electric motor, bolts passing through the mounting bosses to fasten the casing to the engine body; and a plurality of ribs extending to the mounting bosses are projectingly provided in the casing of the actuator.

With this arrangement of the seventh feature, the mounting bosses for mounting the casing to the engine body are provided in the casing at a plurality of spots in the periphery of the electric motor, the casing can be firmly fixed to the engine body at the portion corresponding to the electric motor which is the vibration generating source of the actuator, thereby enhancing vibration resistance and durability of the actuator mounted to the engine body, and enhancing the control accuracy of the control shaft and controllability of exhaust property. In addition, distortion of the casing can be prevented by the ribs extending to the respective mounting bosses, increase in the sliding friction force is avoided between components, which are supported by the casing and in contact with each other, among a plurality of components constructing the actuator, and driving force which should be exhibited by the electric motor is reduced to achieve energy saving.

According to an eighth feature of the present invention, in addition to the first feature, a deceleration ratio of the deceleration mechanism is set at a value at which maximum efficiency of the electric motor is obtained when quickest response is performed to required driving torque.

With this arrangement of the eighth feature, the heat generation amount of the electric motor is minimized when the variable lift mechanism is under the harshest operational conditions, extension of the life of the electric motor is achieved by suppressing heat generation of the electric motor, thermal distortion is prevented from generating in the casing of the actuator, and heat is prevented from affecting the sensor which detects the rotation amount of the control shaft, thereby enhance detection accuracy. In addition, since a special cooling structure is not required, increase in size and cost of the actuator can be avoided.

The above-mentioned object, other objects, characteristics, and advantages of the present invention will become apparent from a preferred embodiment, which will be described in detail below by reference to the attached drawings.

DESCRIPTION OF THE PREFERRED EMBODIMENT

Figure 1:
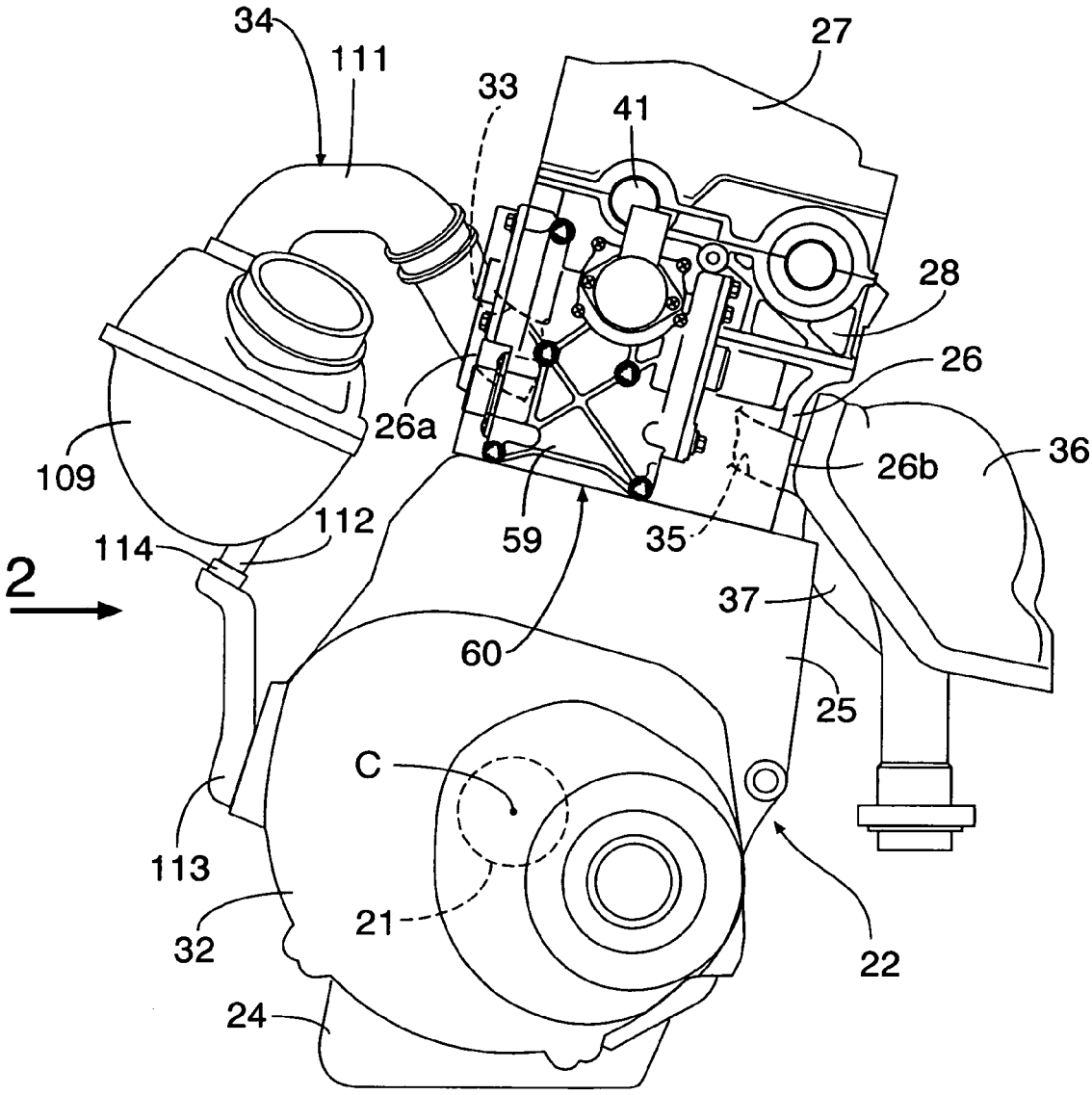
FIG. 1 is a side view of an internal combustion engine including a variable lift valve operating system according to an embodiment of the present invention, in a state in which the internal combustion engine is mounted on a vehicle.
Figure 2:
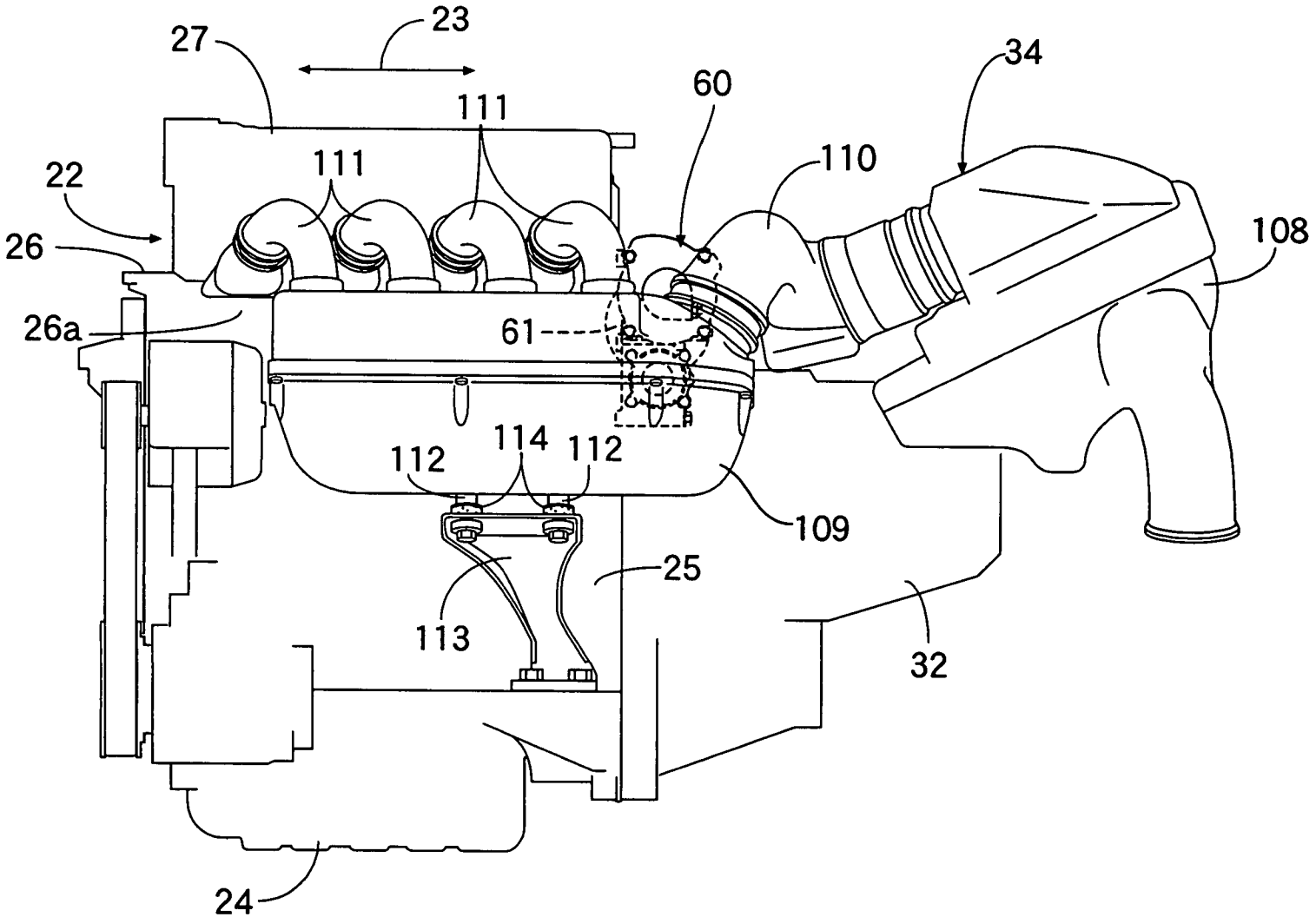
FIG. 2 is a view seen in arrow 2 in FIG. 1.

One embodiment of the present invention is described with reference to FIGS. 1 to 14. First in FIGS. 1 and 2, a multiple-cylinder, for example, four-cylinder engine body 22 with an axis C of a crankshaft 21 extending along a width direction of a vehicle is mounted on a front part of the vehicle. Cylinders are provided in the engine body 22, side by side in a cylinder arranging direction 23 parallel with the axis C.

The engine body 22 includes a crankcase 24 that rotatably supports the crankshaft 21, a cylinder block 25 connected to the crankcase 24, a cylinder head 26 connected to the cylinder block 25, and a head cover 27 which is connected to the cylinder head 26. A cam holder 28 is connected to the cylinder head 26 at one end of a left side along the cylinder arranging direction 23 to construct a part of the engine body 22, and is disposed to face the outside between the cylinder head 26 and the head cover 27.

A transmission case 32 for accommodating a transmission is connected to a left end of the crankcase 24 in the forward traveling direction of the vehicle, so as to form an available space on the left side of the engine body 22 and above the transmission case 32.

Intake ports 33 for the respective cylinders are provided at one side wall 26*a* (see FIG. 1) facing a front side of the cylinder head 26, and an intake system 34 is connected to the intake ports 33. Exhaust ports 35 for the respective cylinders are provided at the other side wall 26*b* (see FIG. 1) facing a rear side of the cylinder head 26, and an exhaust manifold 37 covered with a heat shield cover 36 from above is connected to the exhaust ports 35.

The intake system 34 includes an air cleaner 108, an intake chamber 109 disposed forward of the cylinder head 26 in common for the respective cylinders, a pipeline member 110 such as a hose which connects together the air cleaner 108 and the intake chamber 109, and a plurality of intake pipes 111 that are separated for the respective cylinders from the intake chamber 109 and are connected to the cylinder head 26. A pair of support legs 112 and 112 are provided at the intake chamber 109 to extend downward, and these support legs 112 are supported at a bracket 113 which is mounted on the crankcase 24 via elastic members 114.

Figure 3:
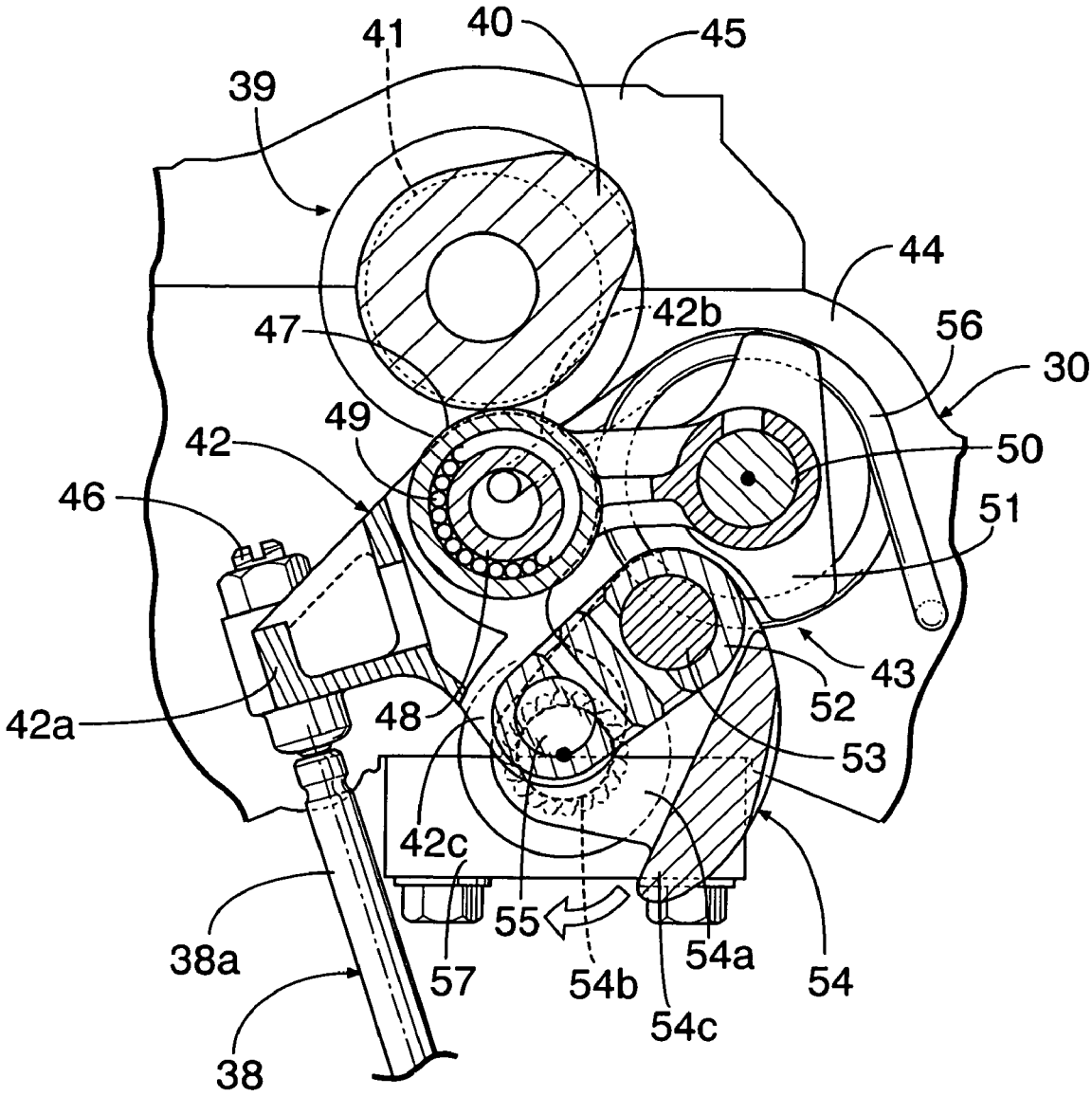
FIG. 3 is a vertical sectional side view of an intake side valve operating system.
Figure 4:
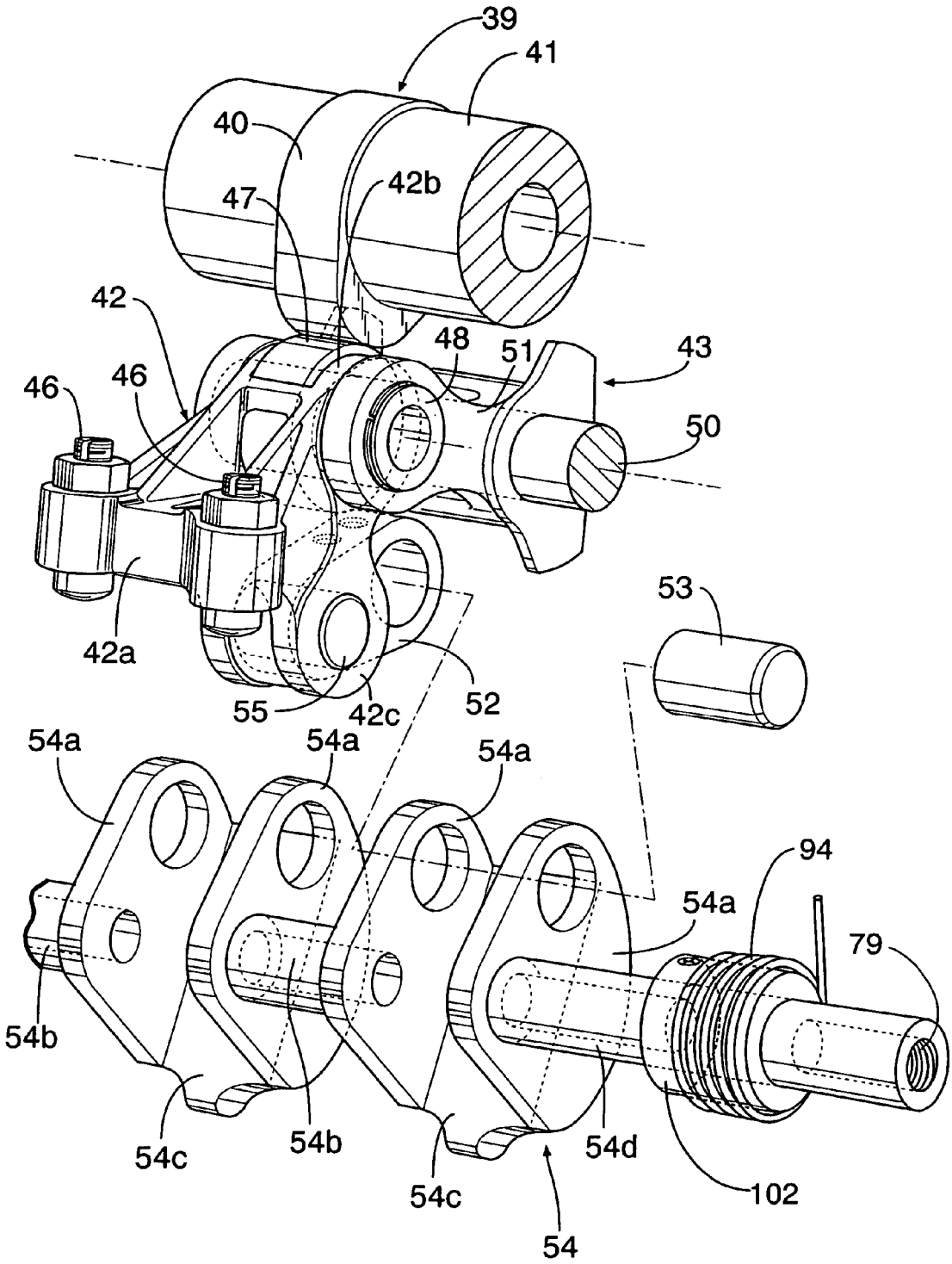
FIG. 4 is an exploded perspective view of the intake side valve operating system.

In FIGS. 3 and 4, in the cylinder head 26, a pair of intake valves 38 are arranged for each of the intake ports 33 to be capable of opening and closing operation, and an intake side valve operating system 39 that drives each of the intake valves 38 to open and close includes an intake side camshaft 41 having an intake side valve operating cam 40 for each cylinder, an intake side rocker arm 42 that swings following the intake side valve operating cam 40, and is operated and connected in common with and to a pair of intake valves 38 for each cylinder, and a variable lift mechanism 43 that continuously changes a valve opening lift amount among the operating characteristics of the intake valves 38.

Upper holders 44 are fastened to the cylinder head 26 to be disposed at opposite sides of each of the cylinders except for one end at the left side along the cylinder arranging direction 23. Caps 45 rotatably supporting the intake side camshaft 41 in cooperation with each of the upper holders 44 are fastened to top surfaces of the upper holders 44. At one end at the left side along the cylinder arranging direction 23, the end portion of the intake side camshaft 41 is rotatably supported between the camshaft 28 and the head cover 27.

A valve connecting part 42*a*, into which tappet screws 46 abutting from above on upper ends of stems 38*a* in a pair of intake valves 38 are screwed so that their advance and retreat positions are adjustable, is provided at one end portion of the intake side rocker arm 42. A first support part 42*b* and a second support part 42*c* which is disposed below the first support part 42*b* are provided at the other end portion of the intake side rocker arm 42 to connect to each other. The first and second support parts 42*b* and 42*c* are each formed into a substantially U shape which opens on a side opposite from the intake valves 38.

A roller 47 in rolling contact with the intake side valve operating cam 40 of the intake side camshaft 41 is supported on the first support part 42*b* of the intake side rocker arm 42 via a first connecting shaft 48 and a needle bearing 49. The roller 47 is disposed to be caught in the first support part 42*b* having a substantially U shape.

The variable lift mechanism 43 includes a first link arm 51 which has one end portion rotatably connected to the first support part 42*b* of the intake side rocker arm 42 and the other end portion rotatably supported at a fixed support shaft 50, a second link arm 52 which has one end portion rotatably connected to the second support part 42*c* of the intake side rocker arm 42 and the other end portion rotatably supported at a movable support shaft 53, and a control shaft 54 which is connected to the movable support shaft 53 to be capable of angularly displacing the movable support shaft 53 around an axis that is parallel with the axis of the movable support shaft 53.

The one end portion of the first link arm 51 is formed into a substantially U-shape to catch the first support part 42*b* of the intake side rocker arm 42 from opposite sides, and is rotatably connected to the first support part 42*b* via the first connecting shaft 48 supporting the roller 47 at the intake side rocker arm 42. The fixed support shaft 50 rotatably supporting the other end portion of the first link arm 51 is supported by the upper holder 44.

The one end portion of the second link arm 52 disposed below the first link arm 51 is disposed to be caught in the second support part 42*c* of the intake side rocker arm 42, and is rotatably connected to the second support part 42*c* via a second connecting shaft 55.

Both the intake valves 38 are biased in a valve closing direction by a valve spring not shown. When both the intake valves 38 which are biased in the valve closing direction by the spring are driven in a valve opening direction with the intake side rocker arm 42, the roller 47 of the intake side rocker arm 42 is in contact with the intake side valve operating cam 40 due to the biasing force of the valve spring. However, in the valve closing state of the intake valves 38, the biasing force of the valve spring does not act on the intake side rocker arm 42, and the roller 47 separates from the intake side valve operating cam 40, leading to a possibility of reducing the control accuracy of the valve lift amount at the time of very slightly opening the intake valves 38. Therefore, the intake side rocker arm 42 is biased in a direction to cause the roller 47 to abut on the intake side valve operating cam 40 by a rocker arm biasing spring 56 which is a member separate from the valve spring.

The control shaft 54 is a single piece in common use for a plurality of cylinders arranged in a line, and is constructed into an integral crank shape, having webs 54*a* which are disposed at opposite sides of the intake side rocker arm 42, shaft parts 54*b* which perpendicularly connect to outer surfaces of base end portions of both the webs 54*a*, and connecting parts 54*c* which connect both the webs 54*a* for each cylinder. The movable support shaft 53 having the axis parallel with the fixed support shaft 50 and the shaft parts 54*b* is connected to the control shaft 54 to connect together both the webs 54*a*. The shaft parts 54*b* are rotatably supported by the upper holders 44 and lower holders 57 which are fastened to lower surfaces of the respective upper holders 44.

When the intake valves 38 are in the valve closing state, the second connecting shaft 55 for connecting the second link arm 52 to the intake side rocker arm 42 is on the same axis as that of the shaft parts 54*b* of the control shaft 54. When the control shaft 54 swings around the axis of the shaft parts 54*b*, the movable support shaft 53 moves on an arc with the axis of the shaft parts 54*b* as a center.

When the control shaft 54 rotates in the direction in which the movable support shaft 53 descends, and the roller 47 is pressed with the intake side valve operating cam 40 of the intake side camshaft 41, a four-joint link which connects together the fixed support shaft 50, the first connecting shaft 48, the second connecting shaft 55 and the movable support shaft 53, deforms to swing the intake side rocker arm 42 downward, and the tappet screws 46 press the stems 38*a* of the intake valves 38 to open the intake valves 38 with low lift.

When the control shaft 54 rotates in a direction in which the movable support shaft 53 ascends, and the roller 47 is pressed with the intake side valve operating cam 40 of the intake side camshaft 41, the four-joint link deforms to swing the intake side rocker arm 42 downward, and the tappet screws 46 press the stems 38*a* of the intake valves 38 to open the intake valves 38 with high lift.

The one end portion of the control shaft 54 along the cylinder arranging direction 23, namely, a shaft part at the one end side along the cylinder arranging direction 23 among a plurality of shaft parts 54*b* of the control shaft 54 is formed to be relatively long as a connecting shaft part 54*d*. The connecting shaft part 54*d* protrudes to the left side of the cylinder head 26, and into a casing 59 of an actuator 60 which is mounted to the outer surface of the end wall of the left side of the cylinder head 26.

Figure 5:
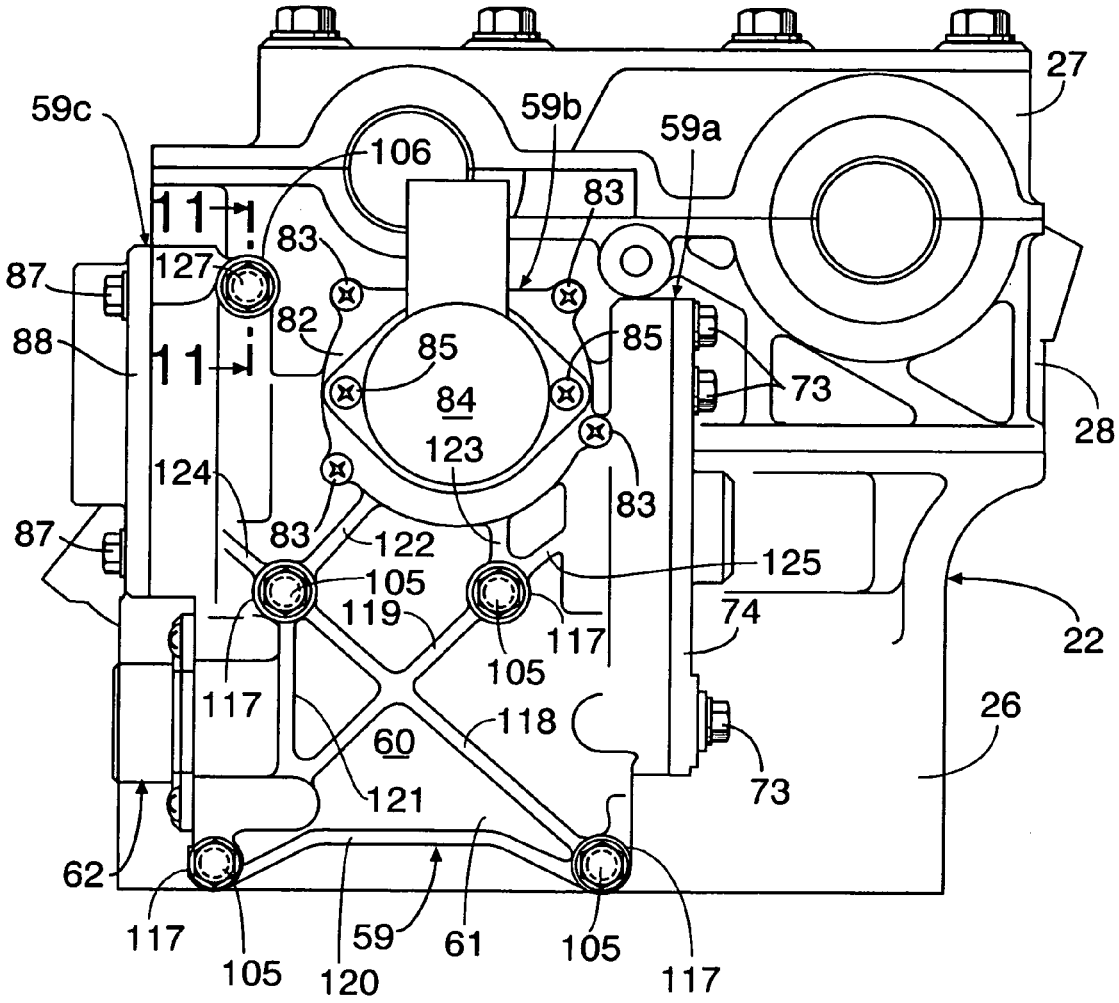
FIG. 5 is an enlarged view of an essential part of FIG. 1.
Figure 6:
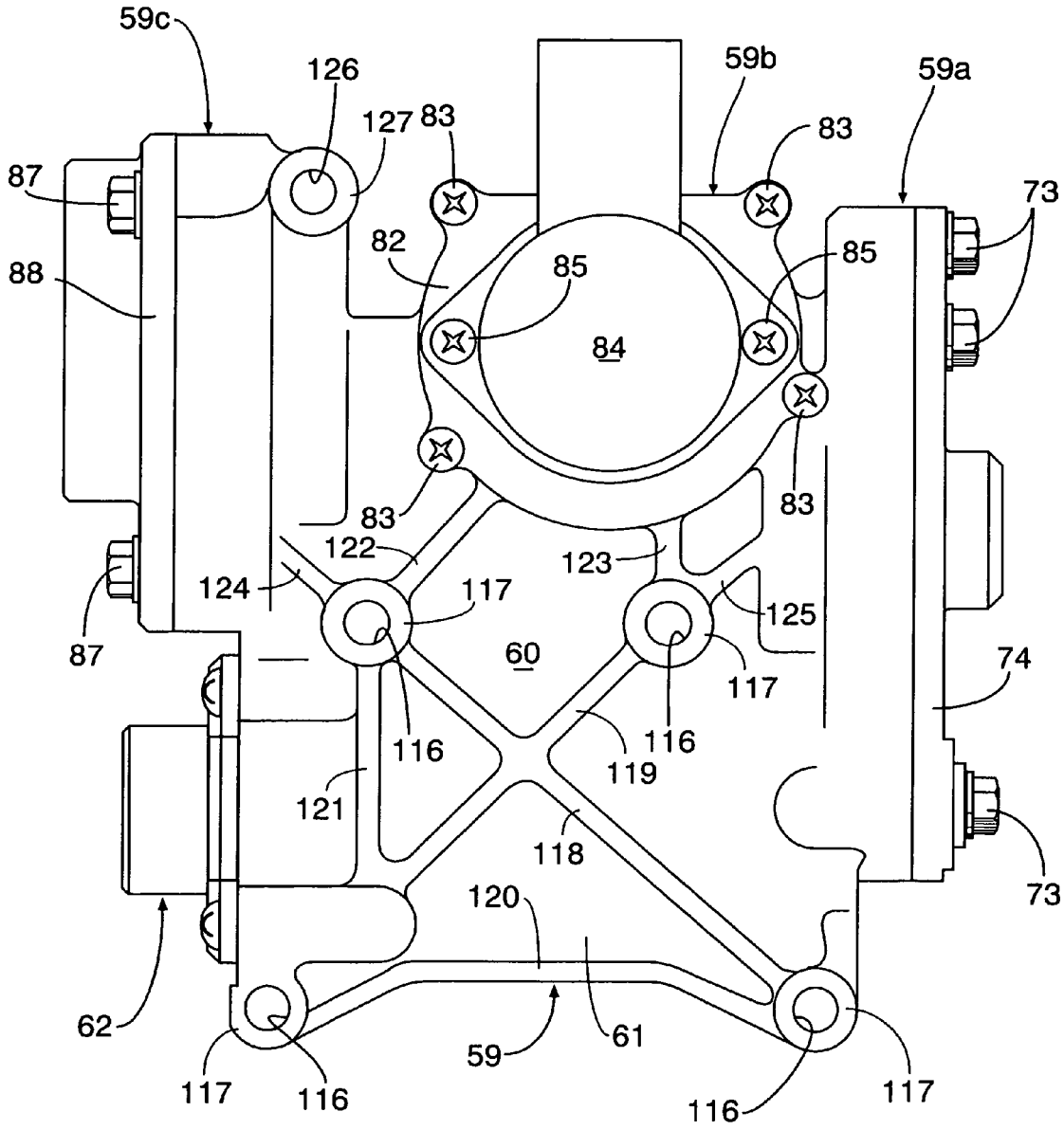
FIG. 6 is a side view of an actuator.
Figure 7:
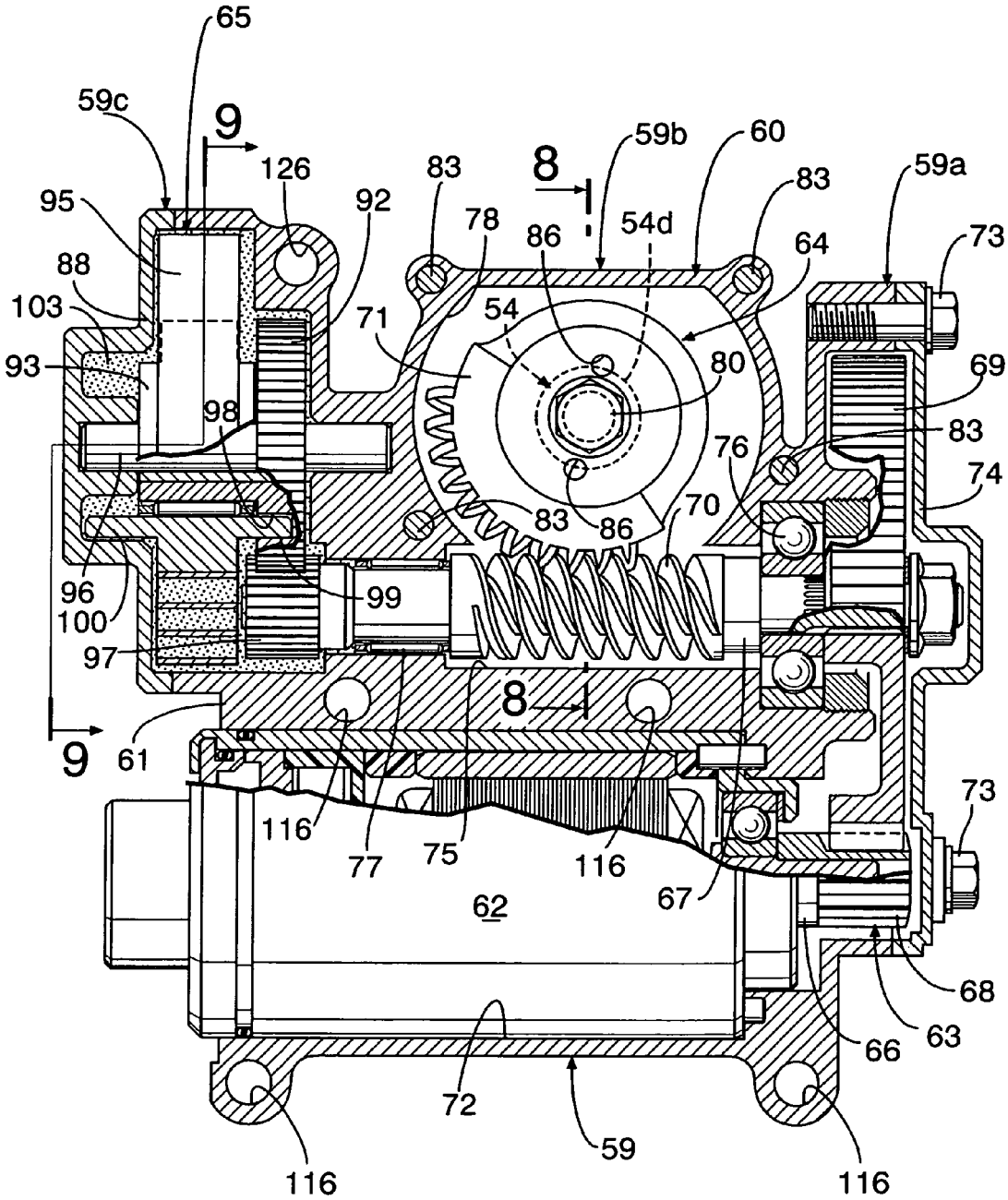
FIG. 7 is a vertical sectional side view of the actuator.

In FIGS. 5 to 7, the actuator 60 comprises an electric motor 62, a deceleration mechanism 63 which decelerates output power of the electric motor 62, a transmission mechanism 64 which is provided between the deceleration mechanism 63 and the connecting shaft part 54*d* of the control shaft 54, and a main part of a default mechanism 65 for maintaining the connecting shaft part 54*d*, namely, the control shaft 54 in a predetermined rotation position when the electric motor 62 is not energized, which are all accommodated in the casing 59. The casing 59 is constructed by a casing main body 61, a first cover 74 fastened to the casing main body 61, a lid member 82, and a second cover 88.

The deceleration mechanism 63 is provided between an output shaft 66 of the electric motor 62 forwardly and reversely rotatable with a default position by the default mechanism 65 as a zero position, and a drive shaft 67 parallel with an axis of the output shaft 66. The deceleration mechanism 63 comprises a driven gear 68 fixed to the output shaft 66, and a follow gear 69 which is meshed with the driven gear 68 and is fixed to the drive shaft 67. The drive shaft 67 rotates in a range of one rotation or more in accordance with the electric motor 62 rotating within an operation range in which the lift amount of the intake valves 38 is changed from the maximum lift amount to the minimum lift amount, for example, to complete closing. The power transmission means 64 comprises a worm gear 70 provided at the drive shaft 67, and a worm wheel 71 which is meshed with the worm gear 70 and is fixed to the connecting shaft part 54*d* of the control shaft 54.

A motor accommodation hole 72 circular in cross-section is provided in a lower portion of the casing main body 61 to extend in the longitudinal direction at the time of the engine body 22 being mounted on the vehicle, and the electric motor 62 is fitted in and fixed to the motor accommodation hole 72. A first cover 74 is fastened by a plurality of bolts 73 to one side wall of the casing main body 61 which becomes a rear side wall at the time of the engine body 22 being mounted on the vehicle. A deceleration mechanism accommodation part 59*a* which is constructed by a part of the casing main body 61 and the first cover 74 to accommodate the deceleration mechanism 63 is formed to extend upward above the electric motor 62 at a position rearward of the electric motor 62 at the time of being mounted on the vehicle.

The worm gear 70 is accommodated in a worm gear accommodation hole 75 provided in the casing main body 61 parallel with the motor accommodation hole 72 above the motor accommodation hole 72, and is provided on an outer periphery of the drive shaft 67 whose one end portion is rotatably supported at the casing main body 61 via a ball bearing 76 while the other end portion is rotatably supported at the casing main body 61 via a needle bearing 77.

Figure 8:
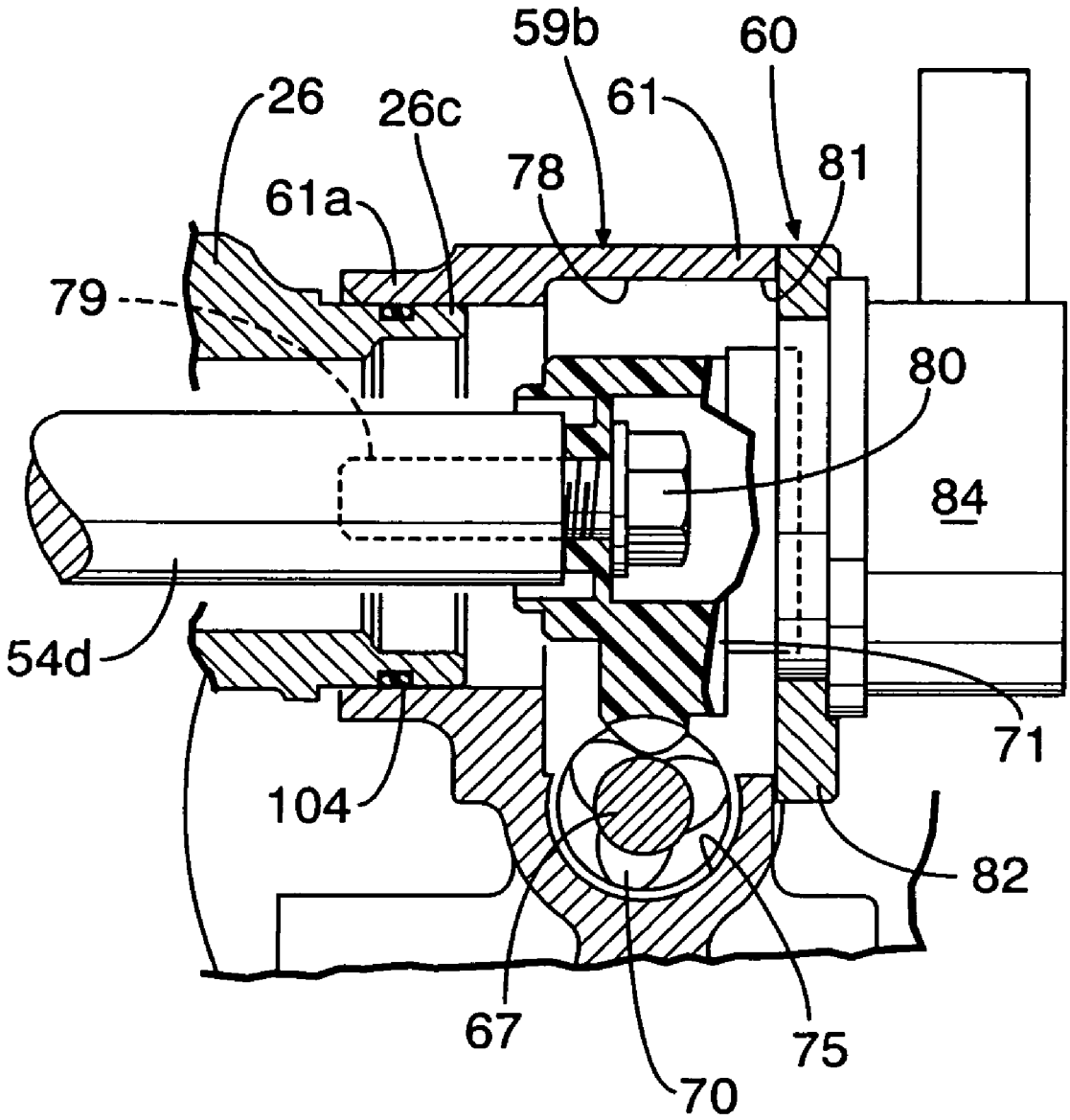
FIG. 8 is a sectional view taken along line 8-8 in FIG. 8.

Referring also to FIG. 8, a worm wheel accommodation chamber 78 leading to an intermediate portion of the worm gear accommodation hole 75 is formed in the upper portion of the casing main body 61, and accommodates therein the worm wheel accommodation chamber 71. Thus, the connecting shaft part 54*d* of the control shaft 54 protrudes into the worm wheel accommodation chamber 78, and the worm wheel 71 is fastened and fixed to the connecting shaft part 54*d* with a bolt 80 which is screwed into a screw hole 79 coaxially provided in an end portion of the connecting shaft part 54*d*.

An opening 81 is provided in an upper portion of the casing main body 61 at a side opposite from the cylinder head 26, and a lid member 82 which blocks the opening 81 is fastened to the casing main body 61 with a plurality of screw members 83. Thus, a transmission mechanism accommodation part 59*b*, which is constructed by a part of the casing main body 61 and the lid member 82 to accommodates the transmission mechanism 64, is formed to be located forward of the deceleration mechanism accommodation part 59*a* at the time of being mounted on the vehicle.

A sensor 84 being a position sensor, which detects a rotation amount of the control shaft 54, is mounted to the lid member 82 with a plurality of screw members 85 to oppose to the worm wheel 65. A pair of detection holes 86 and 86 in which the sensor 84 is engaged are provided in the worm wheel 65.

A second cover 88 is fastened by a plurality of bolts 87 to the other side wall of the casing main body 61 on a side opposite from the deceleration mechanism accommodation part 59*a* with respect to the transmission mechanism accommodation part 59*b*. A default mechanism accommodation part 59*c*, which is constructed by a part of the casing main body 61 and the second cover 88 to accommodate a main part of a default mechanism 65, is formed with the transmission mechanism accommodation part 59*b* between the default mechanism accommodation part 59*c* and the deceleration mechanism accommodation part 59*a*.

Figure 9:
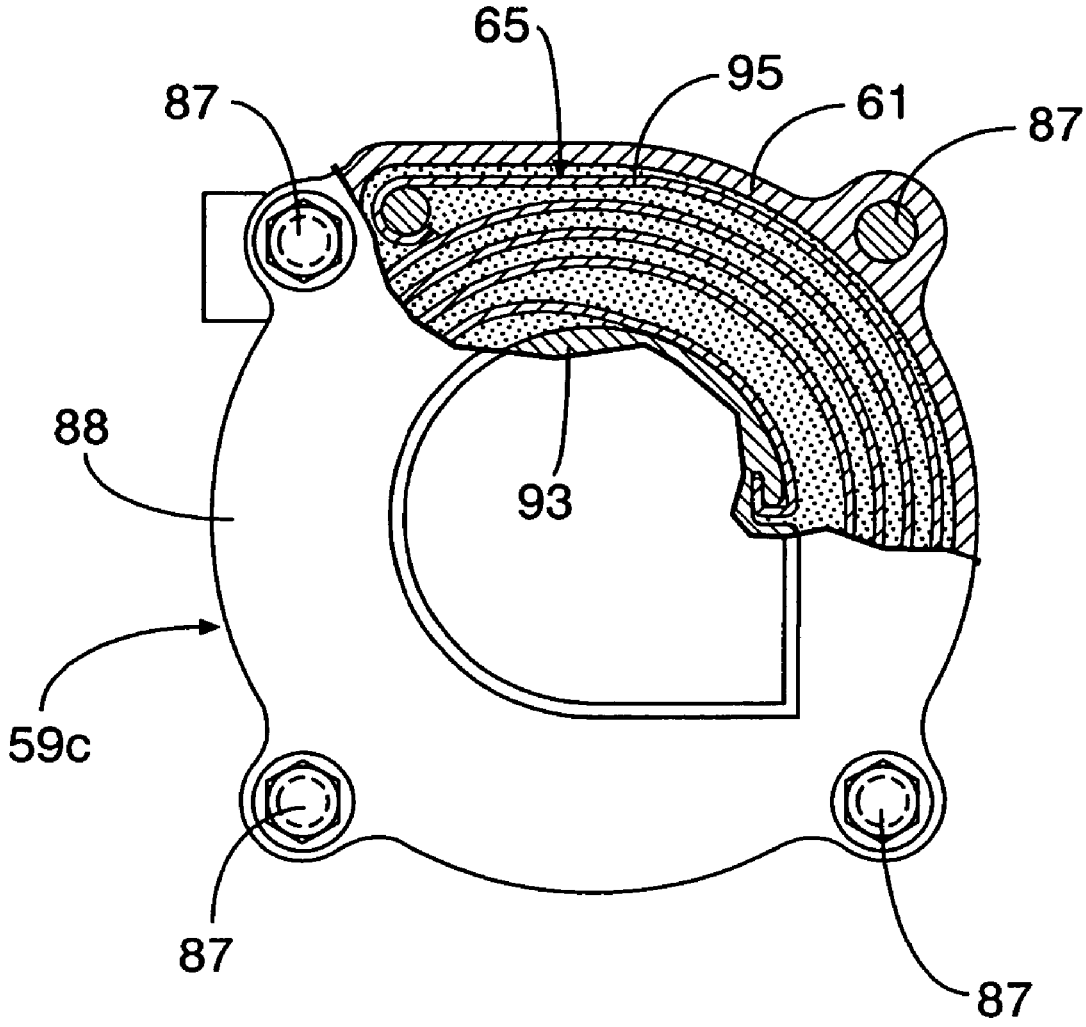
FIG. 9 is a sectional view taken along line 9-9 in FIG. 7.

Referring also to FIG. 9, the default mechanism 65 includes a default shaft 96 which is a separate member from the drive shaft 67 and has an axis parallel with the drive shaft 67, a large diameter gear 92 which is moved with and connected to the drive shaft 67 to be rotatable around the axis of the default shaft 66, a spring holder 93 capable of rotating around the same axis with the large diameter gear 92, a return spring 94 (see FIG. 4) which biases the large diameter gear 92 in a direction to abut on and engage with the spring holder 93, and a default spring 95 which biases the spring holder 93 in the direction opposite from the return spring 94 in the abutting and engaging state of the large diameter gear 92 and the spring holder 93.

The large diameter gear 92 is rotatably supported by the default shaft 96 whose opposite ends are supported by the casing main body 61 and the second cover 88, and is meshed with a small diameter gear 97 provided at the other end portion of the drive shaft 67. Namely, the large diameter gear 92 is moved with and connected to the electric motor 62 via the small-diameter gear 97, the drive shaft 67 and the deceleration mechanism 63, so that the large diameter gear 92 rotates in the rotation range of less than one rotation in accordance with the electric motor 62 rotating within the operation range in which the lift amount of the intake valves 38 is changed from the maximum lift amount to the minimum lift amount, for example, to complete closing. Namely, the large diameter gear 92 is moved with and connected to the electric motor 62 to rotate in the rotation range of less than one rotation in accordance with the rotation of the electric motor 62 within the range of the change in the lift amount of the intake valves 38.

The spring holder 93 is supported on the default shaft 96 to be rotatable relatively to the large diameter gear 92. A groove 98 in the shape of an arc with the axis of the default shaft 96 as the center is provided on the opposing surface of the large diameter gear 92 to the spring holder 93. An engaging protrusion 99 which is inserted in the groove 98 is provided to protrude at the spring holder 93. Thus, the engaging protrusion 99 abuts on and engages with one end of the groove 98 along the circumferential direction of the large diameter gear 92 in accordance with the rotation of the large diameter gear 92 while the lift amount of the intake valves 38 is changed between a predetermined lift amount and the minimum lift amount. When the large diameter gear 92 rotates to change the lift amount of the intake valves 38 between the predetermined lift amount and the minimum lift amount, the spring holder 93 rotates around the same axis with the large diameter gear 92. A restricting protrusion 100 projectingly provided on the spring holder 93 abuts on a stopper 101 (see FIG. 10) provided at the second cover 88 in accordance with the rotation of the spring holder 93 when the lift amount of the intake valves 38 is changed from the minimum lift amount to the predetermined lift amount, thereby restricting the rotation of the spring holder 93. The rotation range of the spring holder 93 is restricted to a range between the predetermined lift amount and the minimum lift amount.

One end of the spiral default spring 95 is engaged with the spring holder 93, and the other end is engaged with a pin 88*a* which is implanted in the second cover 88. Thus, the default spring 95 exerts a spring force which biases the spring holder 93 from the minimum lift amount side to the predetermined lift amount side, and its spring load is set to be larger than the return spring 94.

Referring carefully to FIG. 4, a cylindrical spring holder 102 surrounding the connecting shaft part 54*d* is fixed to the connecting shaft part 54*d* of the control shaft 54 inside the cylinder head 26, and the return spring 94 that is a torsion coil spring is wound around the spring holder 102. One end of the return spring 94 is engaged with the cylinder head 26, and the other end is engaged with the spring holder 102.

Namely, the return spring 94 is interposed between the connecting shaft part 54*d* of the control shaft 54 and the cylinder head 26 so as to perform not only the function of biasing the large diameter gear 92 in the direction to abut on and engage with the spring holder 93, but also the function of absorbing backlash between the worm wheel 71 and the worm gear 70.

In this manner, the default mechanism accommodation part 59*c* of the actuator 60 accommodates the main part except for the return spring 94, namely, the large diameter gear 92, the spring holder 93 and the default spring 95, among the large diameter gear 92, the spring holder 93, the return spring 94 and the default spring 95 which construct the default mechanism 65, that is, only the return spring 94 is disposed in the cylinder head 26. A grease 103 is charged into the default mechanism accommodation part 59*c*.

Figure 10:
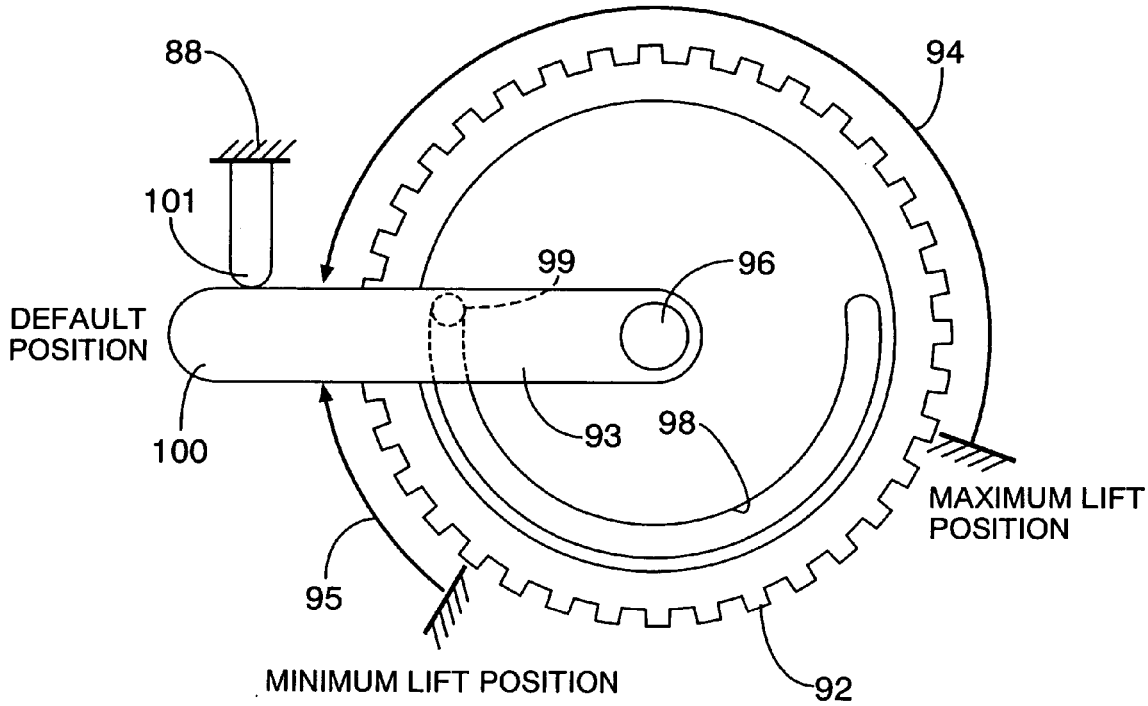
FIG. 10 is a schematic view for explaining a construction of a default mechanism.

Describing the operation of the default mechanism 65 by referring to FIG. 10 schematically showing the construction of the default mechanism 65, the large diameter gear 92 is biased by the return spring 94 from the maximum lift position to the minimum lift position side, and the spring holder 93, which has the rotation range restricted to the range from the minimum lift position to the default position that is the position to provide the predetermined lift amount of the intake valves 38, is biased from the minimum lift position to the default position side by the default spring 95 which has a larger spring load than the return spring 94. Accordingly, in the non-energized state of the electric motor 62, the large diameter gear 92 is biased by the return spring 94 to rotate to the position where the engaging protrusion 99 of the spring holder 93 is caused to abut on and engage with one end of the engaging groove 98; and the spring holder 93 is rotated to the default position by the default spring 95. The large diameter gear 92, which is moved with and connected to the control shaft 54 via the small diameter gear 94, the drive shaft 67, the worm gear shaft 70, and the worm wheel 71, also enters the default position, whereby the lift amount of the intake valves 38 is kept at the predetermined amount.

Incidentally, at least one of the worm wheel 71 and the worm gear 70, which construct a part of the actuator 60 and are meshed with each other, is formed of a synthetic resin. In this embodiment, the worm wheel 71 is formed of a synthetic resin such as, for example, nylon and PEEK (trade name of Victrex plc.).

As clearly shown in FIG. 8, a cylindrical barrel part 61*a* leading to the worm wheel accommodation chamber 78 is provided at the casing main body 61 of the casing 59; a cylindrical barrel part 26*c* which coaxially surrounds the connecting shaft part 54*d* of the control shaft 54 is provided at a left end wall of the cylinder head 26 to be fittable to the barrel part 61*a*; and an O-ring 104 which elastically contacts an inner periphery of the barrel part 61*a* is fitted to an outer periphery of the barrel part 26*c*. Namely, the casing main body 61 and the cylinder head 26 are fitted to each other in the direction along the axis of the connecting shaft part 54*d* of the control shaft 54.

The casing 59 of the actuator 60 is mounted astride to the cylinder head 26 and the cam holder 28, which are the components of the engine body constructing a part of the engine body 22. Specifically, the casing main body 61 of the casing 59 is mounted to the cylinder head 26 with a plurality of bolts 105 (see FIG. 5), and also mounted to the cam holder 28 with bolts 106 (see FIG. 5).

Mounting bosses 117 having insertion holes 116 are provided at the casing main body 61 of the casing 59 at four spots around the electric motor 62 which is fitted in and fixed to the motor accommodation hole 68. The casing main body 61 is fastened to the cylinder head 26 by the bolts 105 which are inserted through the insertion holes 116.

Ribs 118 to 125 extending to the respective mounting bosses 107 are projectingly provided on the casing main body 61. The ribs 118 and 119 are formed to cross into an X shape to connect the upper mounting bosses 117 and the lower mounting bosses 117. The rib 120 is formed to connect the lower mounting bosses 117. The rib 121 is formed to connect the mounting bosses 117 disposed at an upper position and a lower position as shown in the left side part of FIG. 5. The ribs 122 and 123 are formed to extend to the upper mounting bosses 117, and further extend diagonally upward as extensions of the ribs 118 and 119. The ribs 124 and 125 are formed to diagonally intersect the ribs 122 and 123 to extend diagonally upward from the upper mounting bosses 117 and 117.

The casing main body 61 is mounted to the cam holder 28 of the engine body 22 at a portion corresponding to at least one of the deceleration mechanism 63, the transmission mechanism 64 and the default mechanism 65. In this embodiment, the casing main body 61 is fastened to the cam holder 28 with the bolt 106 at a portion corresponding to the default mechanism 65.

Figure 11:
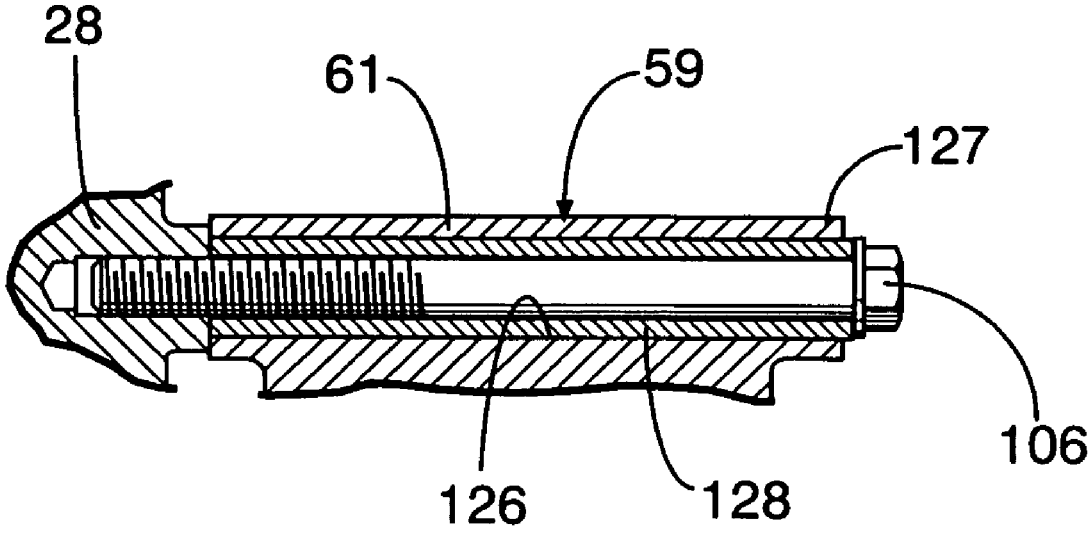
FIG. 11 is a sectional view taken along line 11-11 in FIG. 5.

In FIG. 11, a mounting boss 127 having an insertion hole 126 is provided in the casing main body 61 at the portion corresponding to the default mechanism 65, and the bolt 106 penetrates through a slide bush 128 which is inserted in the insertion hole 126 and is threadedly fitted in the cam holder 28. Namely, at the portion corresponding to the default mechanism 65, the casing main body 61 is fastened to the cam holder 28 via the slide bush 128.

The actuator 60 which controls the lift amount of the intake valves 38 basically operates with the accelerator operation by the vehicle driver, and when the accelerator operation is frequently repeated in a short time, for example, during circuit traveling or traveling on a winding road, the electric motor 62 of the actuator 60 operates in response to such a frequent operation. Thus, the effective current passing through the electric motor 62 becomes large, leading to a possibility that the electric motor 62 generates heat. In this case, if the heat generation of the electric motor 62 is left as it is, there is a possibility that the life of the electric motor 62 is reduced or a thermal distortion generates in the casing 59 of the actuator 60. Further, there is a possibility that the heat affects the sensor which detects the rotation amount of the control shaft 54 to cause a detection error. Then, if the structure for cooling the electric motor 62 is added to the actuator 60, increase in size and cost of the actuator 60 is provided.

Thus, the reduction ratio of the deceleration mechanism 63 is set so that efficiency of the electric motor 62 becomes the highest when the electric motor 62 is caused to make the quickest response in response to the frequently repeated accelerator operation.

Figure 12:
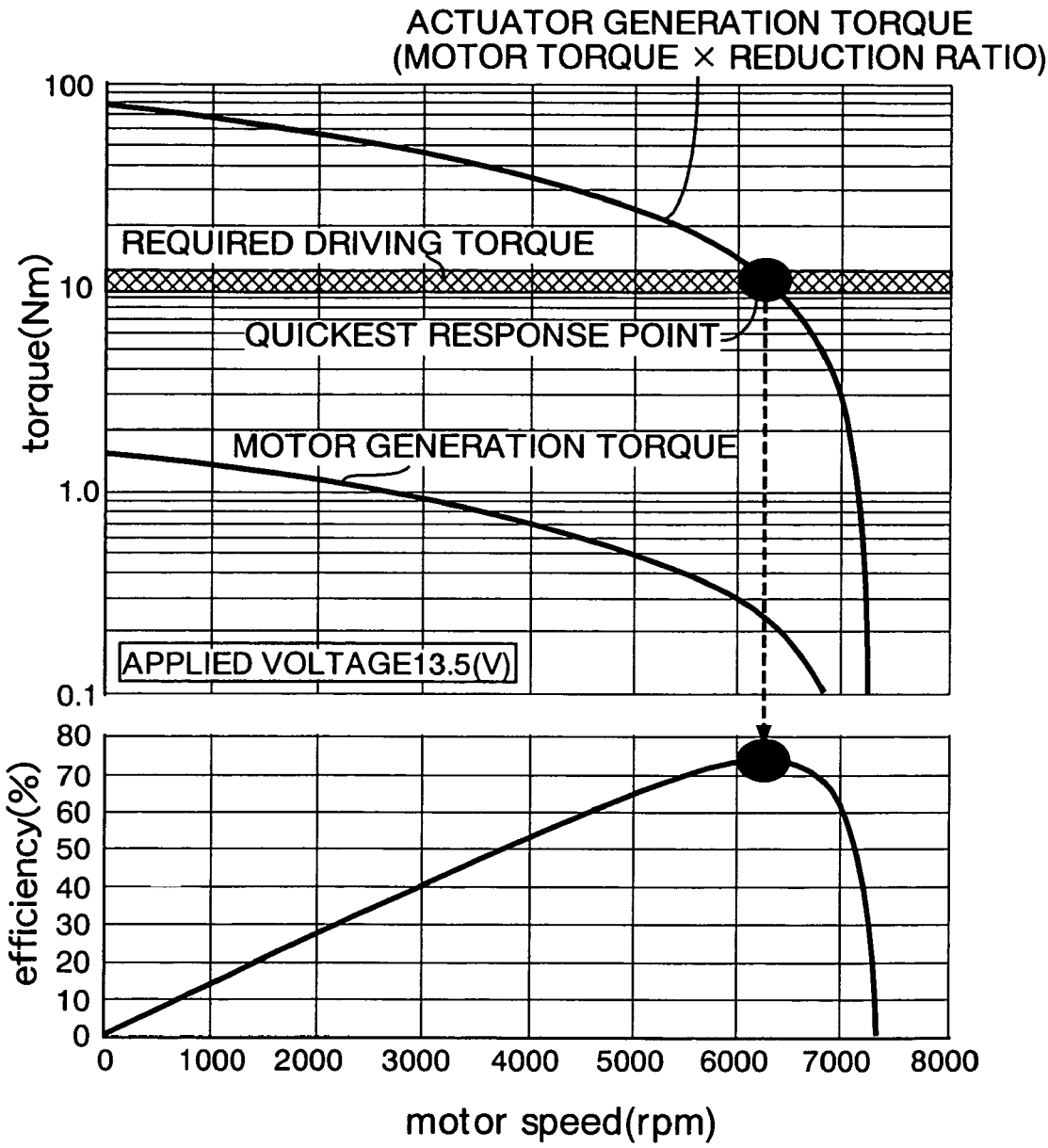
FIG. 12 is a diagram showing efficiency of an electric motor, generating torque of the electric motor, and generating torque of the actuator.

In this case, the efficiency of the electric motor 62 in the actuator 60, the generation torque of the electric motor 62, and the generation torque of the actuator 60 respectively change as shown in FIG. 12 in accordance with the change in the rotational speed of the electric motor 62. When the required driving torque is, for example, 10 Nm, and the quickest response is performed in order to overcome the required driving torque, the generation torque of the actuator 60 is set so that the rotational speed of the electric motor 62 becomes its highest efficiency, for example, 6200 rpm. Thus, the generation torque of the actuator 60 is obtained by the calculation (the generation torque of the electric motor 62× reduction ratio of the deceleration mechanism 63). For example, when the rotational frequency of the electric motor 62 is set at 200 rpm, the reduction ratio of the deceleration mechanism 63 is set at 69.3.

Next, the operation of the first embodiment is described. The actuator 60 rotatably drives the control shaft 54 of the variable lift mechanism 43 capable of changing the lift amount of the intake valves 38. The actuator 60 has the drive shaft 67 moved with and connected to the control shat 54 via the transmission mechanism 64, and the electric motor 62 which exerts the power for rotatably driving the drive shaft 67 to rotate it by one rotation or more within the range of the lift amount change of the engine valves 38. Also, the actuator 60 is provided with at least the main part of the default mechanism 65 capable of rotatably biasing the control shaft 54 to the position where the lift amount of the intake valves 38 becomes the predetermined amount when the electric motor 62 is not energized. The default mechanism 65 includes the default shaft 96 which is the separate member from the drive shaft 67 and has the axis parallel with the drive shaft 67, the large diameter gear 92 which is capable of rotating around the axis of the default shaft 96 and is moved with and connected to the drive shaft 67, and the default spring 95 which rotatably biases the large diameter gear 92.

Therefore, the large diameter gear 92, which rotates around the axis of the default shaft 96, can be moved with and connect to the drive shaft 67 to rotate in the rotation range of less than one rotation in accordance with the rotation of the electric motor 62 within the range of the lift amount change of the intake valves 38, and thus a conventionally-used default mechanism with high durability and reliability can be adopted.

Since the default spring 95 is a spiral type, the default mechanism 65 can be made compact in the direction along the axis of the default shaft 96.

Figure 13:
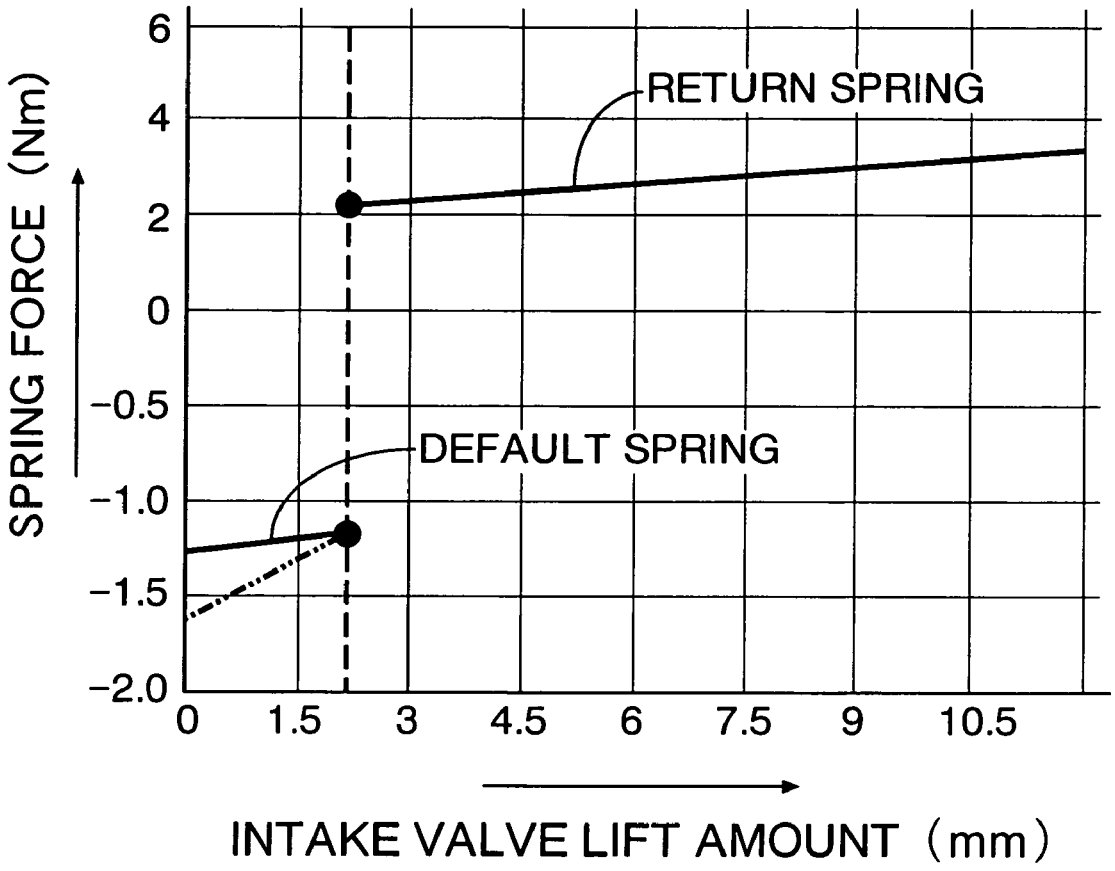
FIG. 13 is a diagram showing a change in a spring force with respect to a lift amount change of an intake valve.

As shown in FIG. 13, the default mechanism 65 keeps the lift amount of the intake valve 38 at, for example, 1.8 mm at the time of its operation, the gradient of the spring constant of the spiral default spring 95 is relatively small as shown by the solid line in FIG. 13, and therefore the load acting on the electric motor 62 is relatively small. On the other hand, in the case where the default spring 95 is of a coil type, the gradient of the spring constant is relatively large as shown by the chain line in FIG. 13. Therefore, unnecessary force is exerted on the electric motor 62 and the work load of the electric motor 62 increases.

When the default spring 95 is of a spiral type, the sliding friction force tends to be large due to interference between sites adjacent in the radial direction of the default spring 95. However, the default mechanism accommodation part 59*c* accommodating the main part which includes the default spring 95 of the default mechanism 65 is formed in the casing 59 of the actuator 60, and the grease 103 is charged in the default mechanism accommodation part 59*c*. Therefore, the sliding friction force is reduced, and the power which should be exerted by the electric motor 62 is reduced to achieve energy saving, leading to reduced fuel consumption.

When the vibration occurs due to the operation of the electric motor 62 of the actuator 60, the vibration affects the control accuracy of the control shaft 54, and as a result, the exhaust property is also influenced thereby. Thus, when mounting the actuator 60 on the engine body 22, it is necessary to firmly fix the peripheral part of the electric motor 62 of the actuator 60 to the engine body 22 thereby enhancing vibration resistance and durability. The casing 59 of the actuator 60 is mounted to the engine body 22 at a plurality of spots of the portion corresponding to the electric motor 62, and is mounted to the engine body 22 at the portion corresponding to at least one of the deceleration mechanism 63, the transmission mechanism 64 and the default mechanism 65 (in this embodiment, the portion corresponding to the default mechanism 65). That is, the portion corresponding to the electric motor 62 which is the vibration generating source of the actuator 60 is firmly fixed to the engine body 22, and the portion which is relatively heavy other than the electric motor 62 is firmly fixed to the engine body 22, thereby suppressing the vibration. Accordingly, vibration resistance and durability of the actuator 60 which is mounted to the engine body 22 are enhanced, and control accuracy of the control shaft 54 and controllability of exhaust property can be enhanced.

In the casing 59, the mounting bosses 117, though which the bolts 105 for fastening the casing 59 to the cylinder head 26 of the engine body 22 are inserted, are projectingly provided at the four spots around the electric motor 62, and a plurality of ribs 118 to 125 extending to the mounting bosses 117 are projectingly provided. Therefore, the ribs 118 to 125 prevent a distortion in the casing 59, and an increase in the sliding friction force between components, which are supported by the casing 59 and in contact with each other, among a plurality of components constructing the actuator 60, whereby the driving force which should be exerted by the electric motor 62 is reduced to achieve energy saving.

Moreover, the portion, which corresponds to the electric motor 62, of the casing 59 is mounted to the cylinder head 26 constructing a part of the engine body 22, and the portion, which corresponds to the default mechanism 65, of the casing 59 is fastened to the cam holder 28 which constructs a part of the engine body 22 and is connected to the cylinder head 26, via a slide bush 128. Therefore, even if there is a displacement of the mounting surfaces of the cylinder head 26 and the cam holder 28 connected to each other, the mounting surfaces facing the actuator 60, the casing 59 can be assembled without distortion to the cylinder head 26 and the cam holder 28, thereby preventing increase in sliding friction force between components, which are supported by the casing 59 and in contact with each other, among the components constructing the actuator 60, reducing the driving force which should be exhibited by the electric motor 62 to achieve energy saving, and further enhancing the control accuracy of the control shaft 54 and controllability of exhaust property.

The reduction ratio of the deceleration mechanism 63 of the actuator 60 is set at a value at which the maximum efficiency of the electric motor 62 can be obtained when the quickest response is made for required driving torque.

With such setting, when the variable lift mechanism 43 is under the harshest operational conditions in which the electric motor 62 operates in response to the accelerator operation being frequently repeated in a short time during circuit traveling or traveling on a winding road, the heat generation amount of the electric motor 62 is minimized. Therefore, by suppressing heat generation of the electric motor 62, the life of the electric motor 62 is extended, a thermal distortion is prevented from generating in the casing 59 of the actuator 60, and the heat is prevented from affecting the sensor 84 which detects the rotation amount of the control shaft 54, thereby enhancing the detection accuracy. In this embodiment, the worm wheel 71 constructing a part of the deceleration mechanism 63 of the actuator 60 is formed from a synthetic resin, thereby preventing the heat from affecting the worm wheel 71 to enhance the durability. In addition, since a special cooling structure is not required, increase in size and cost of the actuator 60 can be avoided.

The deceleration mechanism accommodation part 59*a* accommodating the deceleration mechanism 63, and the default mechanism accommodation part 59*c* accommodating the default mechanism 65 are formed in the casing 59 of the actuator 60 to sandwich therebetween the worm wheel 71 and the sensor 84 which are thermally vulnerable parts directly connected to the control shaft 54.

Figure 14:
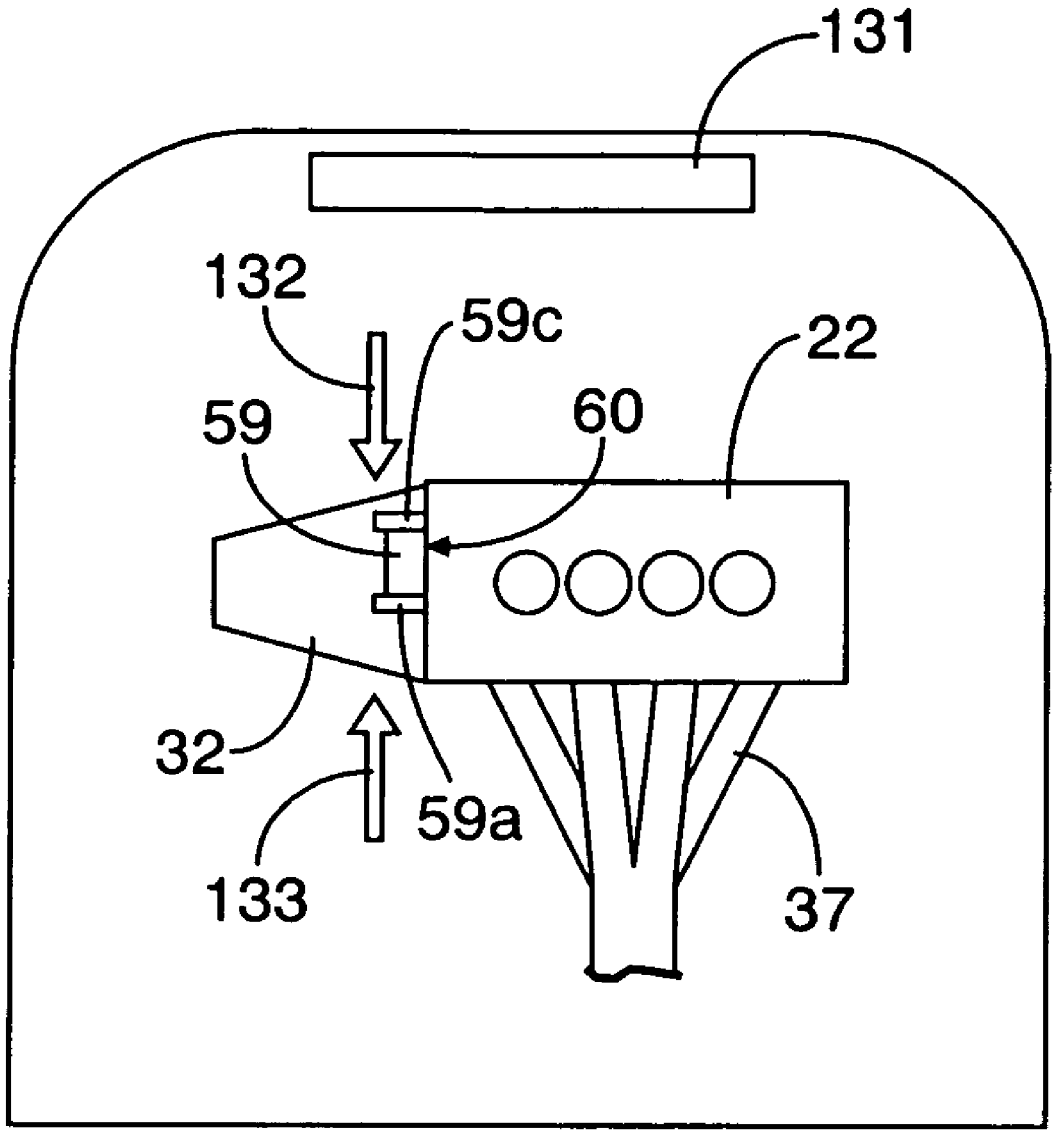
FIG. 14 is a plane view briefly showing relative positions of the internal combustion engine and a radiator in a state in which they are mounted on a vehicle.

Accordingly, as shown in FIG. 14, even if the rearward-blowing wind from the radiator 131 shown by the arrow 132 is blown from the front to the actuator 60 mounted to one end wall of the engine body 22, and the rear portion of the actuator 60 is exposed to radiation heat from the exhaust manifold 37 shown by the arrow 133 in a state in which the engine body 22 is mounted on the vehicle in the lateral direction behind the radiator 131, the deceleration mechanism accommodation part 59*a* and the default mechanism accommodation part 59*c* perform a heat shield function for the worm wheel 71 and the sensor 84, because the worm wheel 71 and the sensor 84 are sandwiched between the deceleration mechanism accommodation part 59*a* and the default mechanism accommodation part 59 which are formed in the casing 59. Therefore, heat damage is prevented from spreading to the worm wheel 71 and the sensor 84, thereby enhancing durability of the worm wheel 71 and the sensor 84.

Although the sensor 84 for detecting the rotation amount of the control shaft 54 particularly changes in characteristics in accordance with the ambient temperature, the sensor 84 is prevented from being directly exposed to hot air and radiation heat, thereby enhancing detection accuracy of the sensor 84.

The synthetic resin worm wheel 71 which constructs a part of the transmission mechanism 64 and is fixed to the control shaft 54 can reduce the weight of the actuator 60 and friction, and prevent heat damage from spreading to the worm wheel 71. Therefore, the reliability and durability is enhanced, and increase in friction due to thermal deformation or the like is prevented, thereby achieving energy saving.

Figure 15:
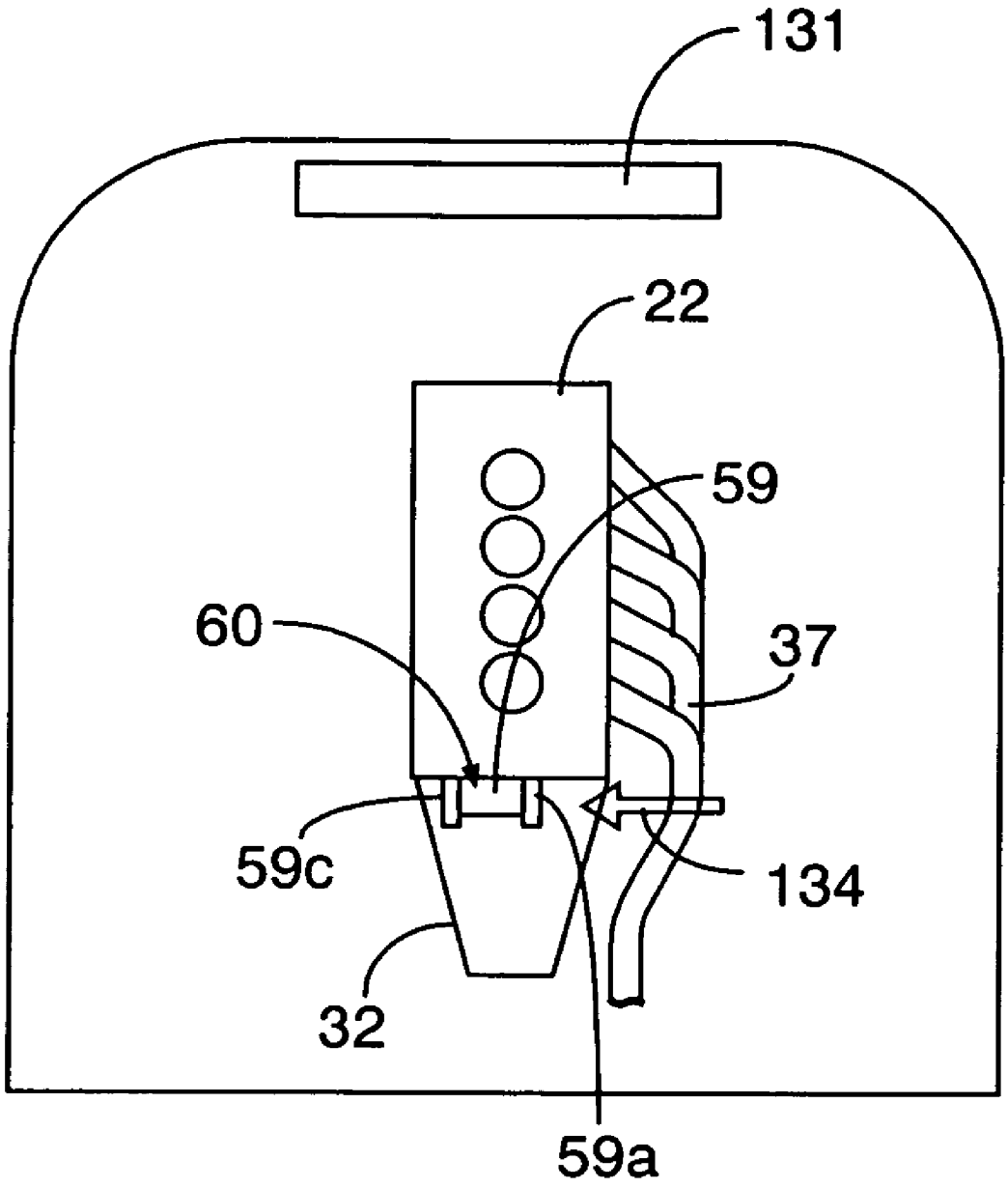
FIG. 15 is a plane view corresponding to FIG. 14 of a first modified example of the embodiment.

As described above, the heat damage is prevented from generating in the worm wheel 71 and the sensor 84, thereby enhancing the degree of freedom of the mounting position of the actuator 60. For example, as shown in a first modified example of this embodiment shown in FIG. 15, when the engine body 22 is mounted on the vehicle in the lateral direction behind the radiator 131, even if the side portion of the actuator 60 is exposed to radiation heat from the exhaust manifold 37 shown by the arrow 134, the deceleration mechanism accommodation part 59*a* can perform the heat shield function for the worm wheel 71 and the sensor 84.

Figure 16:
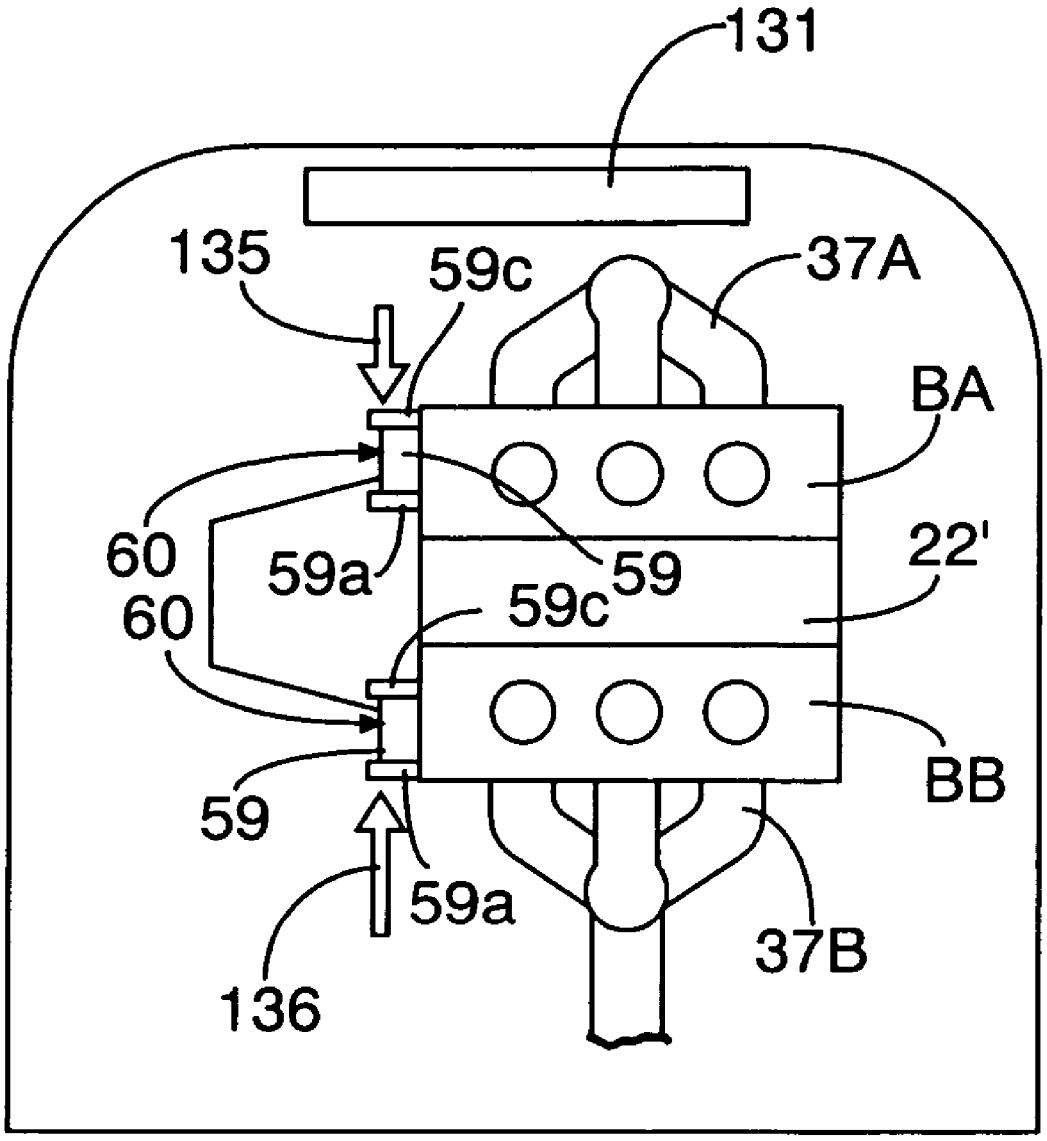
FIG. 16 is a plane view corresponding to FIG. 14 of a second modified example of the embodiment.

FIG. 16 shows a second modified example of this embodiment, in which an engine body 22' constructed into a V shape having a pair of banks BA and BB is mounted on the vehicle in the lateral direction behind the radiator 131. In a state in which the actuators 60 and 60 are mounted to one ends of both the banks BA and BB, rearward-blowing wind of the radiator 131 and the radiation heat of an exhaust manifold 37A are blown from the front to the actuators 60 and 60 as shown by the arrow 135, while the rear portions of the actuators 60 and 60 are exposed to the radiation heat from an exhaust manifold 37B shown by the arrow 136. However, the deceleration mechanism accommodation parts 59*a* and the default mechanism accommodation parts 59*c* of casings 59 perform the heat shield function for the actuators 60 and 60 as described above.

Figure 17:
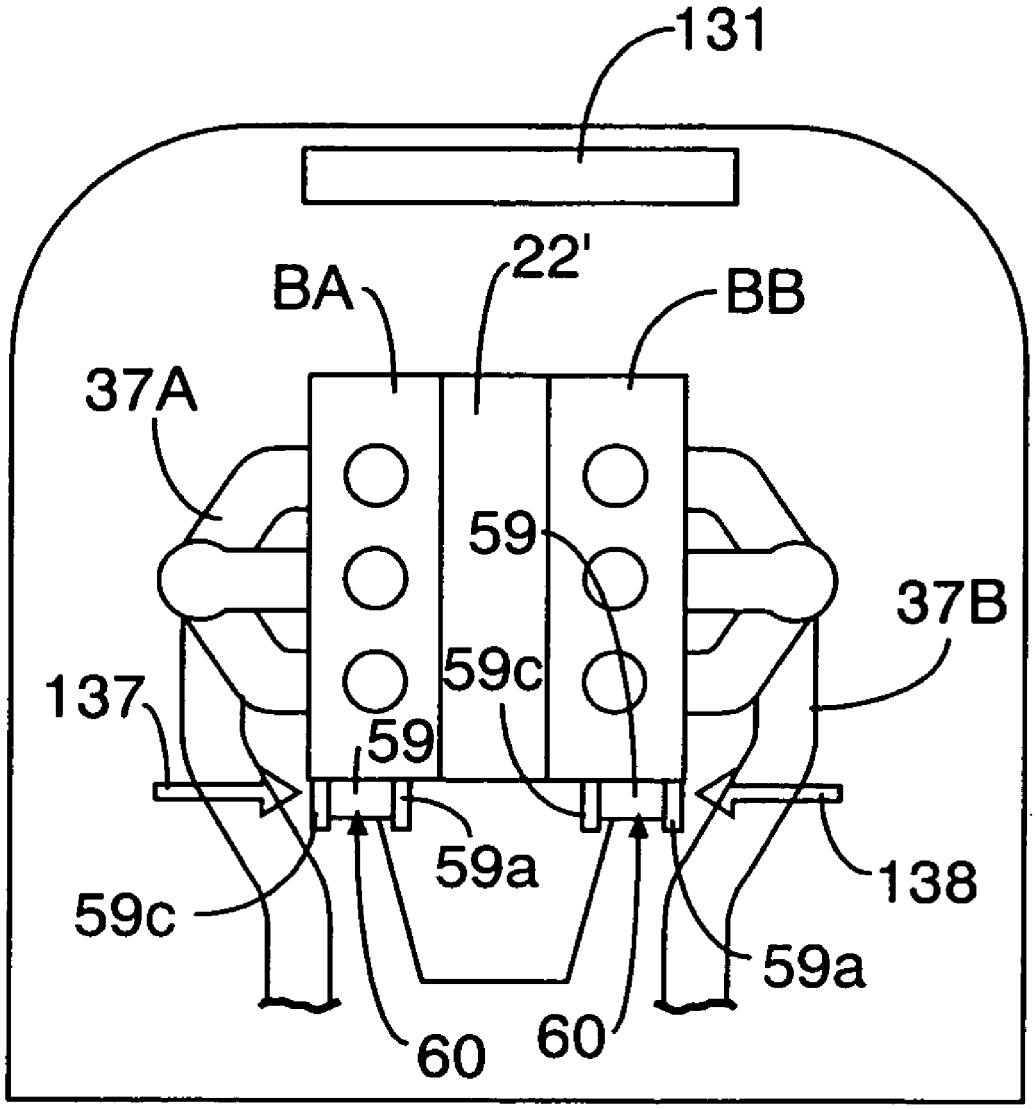
FIG. 17 is a plane view corresponding to FIG. 14 of a third modified example of the embodiment.

As shown in a third modified example of the present embodiment shown in FIG. 17, when the actuators 60 and 60 are mounted to the rear ends of both the banks BA and BB in a state in which the engine body 22' constructed into the V shape is mounted on the vehicle in the longitudinal direction behind the radiator 131, the side portions of the actuators 60 and 60 are exposed to the radiation heat from the exhaust manifold 37A and the exhaust manifold 37B as shown by the arrows 137 and 138. However, the deceleration mechanism accommodation parts 59*a* and the default mechanism accommodation parts 59*c* of the casings 59 perform the same heat shield function as described above.

The embodiment of the present invention has been described, but the present invention is not limited to the above-described embodiment, and various changes in design can be made without departing from the present invention described in the claims.

For example, the present invention can be carried out also for an exhaust valve which is an engine valve.

What is claimed is:

1. A variable lift valve operating system for an internal combustion engine comprising:

an engine valve;

a variable lift mechanism capable of changing a lift amount of the engine valve; and an actuator which is mounted on an engine body to rotatably drive a control shaft of the variable lift mechanism and which includes:

an electric motor;

a deceleration mechanism which decelerates output of the electric motor;

a transmission mechanism interposed between the control shaft and the deceleration mechanism; and a default mechanism capable of rotatably biasing the control shaft to a position where a lift amount of the engine valve becomes a predetermined lift amount when the electric motor is not energized, wherein a deceleration mechanism accommodation part for accommodating the deceleration mechanism and a default mechanism accommodation part for accommodating the default mechanism are formed in a casing of the actuator so as to sandwich therebetween a thermally vulnerable part which is directly connected to the control shaft.

2. The variable lift valve operating system for an internal combustion engine according to claim 1, wherein the thermally vulnerable part is a sensor which detects a rotation amount of the control shaft.

3. The variable lift valve operating system for an internal combustion engine according to claim 1, wherein the thermally vulnerable part is a synthetic resin worm wheel which constitutes a part of the transmission mechanism and is fixed to the control shaft.

4. The variable lift valve operating system for an internal combustion engine according to claim 1, wherein the default mechanism further includes a default shaft which is a separate member from a drive shaft that is moved with and connected to the control shaft and has an axis parallel with the drive shaft, a rotary member which is capable of rotating around the axis of the default shaft and is moved with and connected to the drive shaft, and a default spring which rotatably biases the rotary member; and at least a main part of the default mechanism is provided in the actuator.

5. The variable lift valve operating system for an internal combustion engine according to claim 4, wherein the default spring is of a spiral type.

6. The variable lift valve operating system for an internal combustion engine according to claim 5, wherein the default mechanism accommodation part is formed in the casing of the actuator, the default mechanism accommodation part accommodating a main part of the default mechanism, the main part including at least the default spring; and a grease is charged into the default mechanism accommodation part.

7. The variable lift valve operating system for an internal combustion engine according to claim 1, wherein, in the casing of the actuator, a plurality of mounting bosses are projectingly provided at a plurality of spots around the electric motor, bolts passing through the mounting bosses to fasten the casing to the engine body; and a plurality of ribs extending to the mounting bosses are projectingly provided in the casing of the actuator.

8. The variable lift valve operating system for an internal combustion engine according to claim 1, wherein a deceleration ratio of the deceleration mechanism is set at a value at which maximum efficiency of the electric motor is obtained when quickest response is performed to required driving torque.

* * * * *